US009409049B1

(12) United States Patent
Brunelo et al.

(10) Patent No.: US 9,409,049 B1
(45) Date of Patent: Aug. 9, 2016

(54) PUSH-UP STAND AND DUMBBELL-SUPPORTING BRACKET

(76) Inventors: Daniel C. Brunelo, Cheraw, SC (US); Brian Hatcher, Cheraw, SC (US)

( * ) Notice: Subject to any disclaimer, the term of this patent is extended or adjusted under 35 U.S.C. 154(b) by 641 days.

(21) Appl. No.: 13/351,265

(22) Filed: Jan. 17, 2012

(51) Int. Cl.
*A63B 21/00* (2006.01)
*A63B 21/078* (2006.01)

(52) U.S. Cl.
CPC ..... *A63B 21/078* (2013.01)

(58) Field of Classification Search
USPC ..... 482/49, 141; 248/163.1, 176.1
See application file for complete search history.

(56) References Cited

U.S. PATENT DOCUMENTS 2,990,865 A * 7/1961 Steele ..... 211/70.2
4,036,416 A * 7/1977 Lowe ..... 294/143
4,666,038 A * 5/1987 Minneman ..... 206/315.2
5,209,539 A * 5/1993 Atalay ..... 294/143
D528,612 S * 9/2006 Black ..... D21/686
D555,961 S * 11/2007 Lien et al. ..... D6/552

* cited by examiner

*Primary Examiner* — Jerome w Donnelly

(57) ABSTRACT

The push-up stand and dumbbell-supporting bracket is composed of an inverted "V"-shaped bracket that can support dumbbells on opposing side locations, and in which a handle is provided above and central to said bracket. Dumbbells of equal or differing weights may be supported on said bracket and lifted via said handle in order to conduct different arm-strengthening exercises. The dumbbell-supporting bracket may be further used as a push-up stand regardless of whether dumbbells are supported at said locations. The dumbbell-supporting bracket enables varying weighted or like weighted dumbbells to be supported in order to produce a varying overall weight without requiring multiple dumbbell sets of varying weights.

1 Claim, 5 Drawing Sheets

PUSH-UP STAND AND DUMBBELL-SUPPORTING BRACKET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of exercise equipment, more specifically, a dumbbell-supporting bracket that can be used as either a push-up stand or as a means to perform multiple exercises with multiple dumbbells.

There are a multitude of different types of exercises that can be performed in connection with a dumbbell. Often, varying dumbbell sizes are required when performing different arm-strengthening exercises that utilize different muscle groups. When multiple dumbbell sizes are required, it can become expensive to purchase multiple pairs of dumbbells. Additionally, there is a space requirement that comes in when handling a plurality of dumbbell sets as they collectively can take up a lot of space. It has long been desirable to provide a dumbbell set that can adjust the weight by employing different means.

The device of the present application seeks to overcome the financial burden in purchasing and storing multiple dumbbell sets by providing a dumbbell-supporting bracket that can support two dumbbells thereon. The dumbbell-supporting bracket enables an end user to combine two dumbbells of equal or varying weight together in order to accomplish a particular arm-strengthening exercise that require varying amounts of weight. Once more, the device of the present application may be further used as a push-up stand.

B. Discussion of the Prior Art

As will be discussed immediately below, no prior art discloses a dumbbell-supporting bracket that is composed of an inverted "V"-shaped bracket that includes two locations with which dumbbells may be supported and an elevated grip for use in manipulating the dumbbell-supporting bracket; wherein two dumbbells of equal or varying weights are inserted into the respective locations and thereafter an end user can perform arm-strengthening exercises that traditionally involve a dumbbell; alternatively an end user can lay the bracket upon the ground with or without dumbbells supported thereon, and wherein said bracket acts as a push-up stand; wherein the locations for support of dumbbells are able to support dumbbells of varying weights.

The Emick Patent (U.S. Pat. No. 6,939,274) discloses a dumbbell lifting apparatus with a handle. However, the apparatus is not capable of resting itself upon a ground, and or used in conjunction with a push-up styled exercise.

The Agan Patent (U.S. Pat. No. 5,181,897) discloses an exercise apparatus for performing a push-up. However, the apparatus does not support two dumbbells for use in arm-strengthening exercises or as a push-up stand.

The Johannson et al. Patent (U.S. Pat. No. 4,854,573) discloses an exercise device with a handgrip for performing push-up exercises. However, the exercise device does not support dumbbells thereon for use as either a push-up stand or in use as arm-strengthening exercises similar to use with dumbbells.

The Duty Patent (U.S. Pat. No. 5,607,380) discloses a grip bar for use when performing push-up exercises. Again, the grip bar is only for use with push up exercises, and not for supporting dumbbells in connection with arm-strengthening exercises.

The Tsay et al. Patent (U.S. Pat. No. Des. 354,100) illustrates an ornamental design for a push-up exercise stand, which does not depict dumbbells supported thereon.

The Dubrul et al. Patent (U.S. Pat. No. 7,318,793) discloses a device that allows the forces required to do push-ups and pull-ups. Again, the device does not allow for support of dumbbells thereon and in use in connection with arm-strengthening exercises that traditionally involve the use of dumbbells.

The Rozenblad Patent (U.S. Pat. No. 4,351,525) discloses a multiple exercise device. Again, the device is only for use with push up exercises, and not for supporting dumbbells in connection with arm-strengthening exercises.

The Ngu Patent (U.S. Pat. No. 7,678,031) discloses a weight adjustable dumbbell for performing push-ups. However, the adjustable dumbbell is not a dumbbell-supporting bracket that can be used as a push-up stand or as a means of conducting arm-strengthening exercises by attaching dumbbells of equal or varying weights thereon.

The Erkhaus Patent (U.S. Pat. No. 7,052,445) discloses an adjustable exercise bell. However, the adjustable exercise bell is not a stand that can support dumbbells of equal or varying weights thereon for use as either a push-up stand or in connection with arm-strengthening exercises that are traditionally conducted with a dumbbell.

While the above-described devices fulfill their respective and particular objects and requirements, they do not describe a dumbbell-supporting bracket that is composed of an inverted "V"-shaped bracket that includes two locations with which dumbbells may be supported and an elevated grip for use in manipulating the dumbbell-supporting bracket; wherein two dumbbells of equal or varying weights are inserted into the respective locations and thereafter an end user can perform arm-strengthening exercises that traditionally involve a dumbbell; alternatively an end user can lay the bracket upon the ground with or without dumbbells supported thereon, and wherein said bracket acts as a push-up stand; wherein the locations for support of dumbbells are able to support dumbbells of varying weights of dumbbells are able to support dumbbells of varying weights. In this regard, the push-up stand and dumbbell-supporting bracket departs from the conventional concepts and designs of the prior art.

SUMMARY OF THE INVENTION

The push-up stand and dumbbell-supporting bracket is composed of an inverted "V"-shaped bracket that can support dumbbells on opposing side locations, and in which a handle is provided above and central to said bracket. Dumbbells of equal or differing weights may be supported on said bracket and lifted via said handle in order to conduct different arm-strengthening exercises. The dumbbell-supporting bracket may be further used as a push-up stand regardless of whether dumbbells are supported at said locations. The dumbbell-supporting bracket enables varying weighted or like weighted dumbbells to be supported in order to produce a varying overall weight without requiring multiple dumbbell sets of varying weights.

An object of the invention is to provide a dumbbell-supporting bracket that can be used as a push-up stand or used in connection with arm-strengthening exercises that traditionally involve dumbbells.

A further object of the invention is to provide a dumbbell-supporting bracket that resembles an inverted "V"-shaped bracket.

An even further object of the invention is to provide a dumbbell-supporting bracket that can support two dumbbells at opposing side locations of the bracket, and a handle is located above and central to said bracket.

A further object of the invention is to provide a bracket that can support dumbbells or equal or varying weights such that the overall weight can be adjusted by interchanging dumbbells thereon.

A further object of the invention is to provide a dumbbell-supporting bracket that includes a non-skid pad surface along a bottom of said dumbbell-supporting bracket thereby providing a place with which to form traction with ground when in use as a push-up stand.

A further object of the invention is to provide side locations that support a dumbbell therein consisting of a "U" shaped member such that a dumbbell is easily secured and supported thereon as well as easily removed therefrom.

An even further object of the invention is to provide a handle that is covered in a hand-gripping material that aids an end user in grabbing the device.

These together with additional objects, features and advantages of the push-up stand and dumbbell-supporting bracket will be readily apparent to those of ordinary skill in the art upon reading the following detailed description of presently preferred, but nonetheless illustrative, embodiments of the push-up stand and dumbbell-supporting bracket when taken in conjunction with the accompanying drawings.

In this respect, before explaining the current embodiments of the push-up stand and dumbbell-supporting bracket in detail, it is to be understood that the push-up stand and dumbbell-supporting bracket is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the push-up stand and dumbbell-supporting bracket.

It is therefore important that the claims be regarded as including such equivalent construction insofar as they do not depart from the spirit and scope of the push-up stand and dumbbell-supporting bracket. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
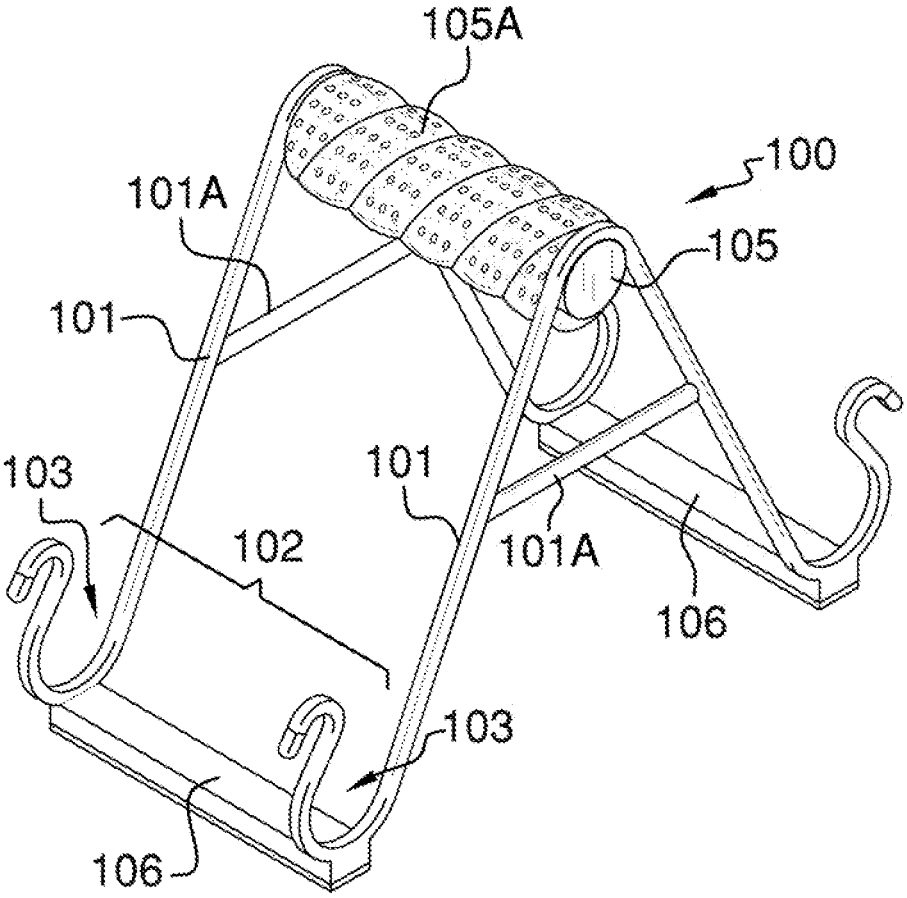
FIG. 1 illustrates a perspective view of the push-up stand and dumbbell-supporting bracket by itself and detailing the inverted "V"-shaped bracket as well as the "U" shaped members located at each side location.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A push-up stand and dumbbell-supporting bracket 100 (hereinafter invention) includes two inverted "V"-shaped brackets 101 that are separated by a depth 102. The "V"-shaped brackets 101 are each defined by "U"-shaped members 103 that form side locations 104.

The side locations 104 and the "U"-shaped members 103 collectively form the means with which dumbbells 130 may be supported on the invention 100.

The depth 102 is a predefined length that shall be less than a handle length 131 of the dumbbell 130. Moreover, the depth 102 is a function of a handle 105 and non-skid pads 106 used to hold together the "V"-shaped brackets 101.

The handle 105 is located at a top-most portion of the invention 100. That being said, the "U"-shaped members 103 and dumbbells 130 are located at a lower elevation when compared to the handle 105. The handle 105 may be covered in a gripping material 105A, which may improve the ability to grip the invention 100 by hand 140 of an end user 141.

Figure 4:
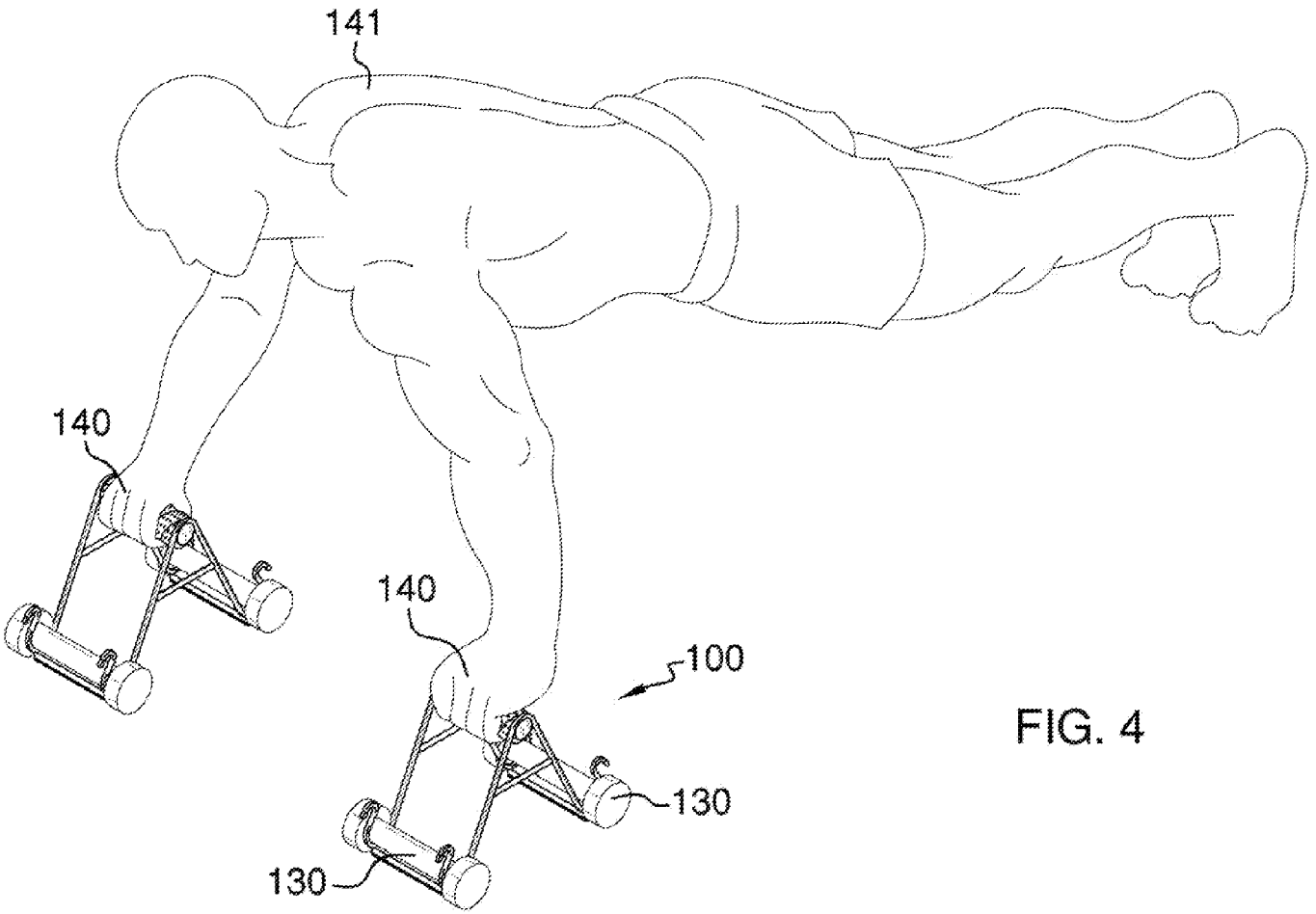
FIG. 4 illustrates a perspective view of the push-up stand and dumbbell-supporting bracket in use as a push-up stand in which an end user is holding handles of two opposing dumbbell-supporting brackets.

The "V"-shaped members 101 may include cross-braces 101A that further support the "V"-shaped members 101 when in use as a push-up stand (see FIG. 4). The cross-braces 101A attach inside of the "V"-shaped member 101, and insures that a span 107 formed between the opposing "U"-shaped members 103 is preserved. In said situation, the cross-braces 101A shall prevent the "V"-shaped members 101 from folding outwardly and collapsing when in use.

Figure 2:
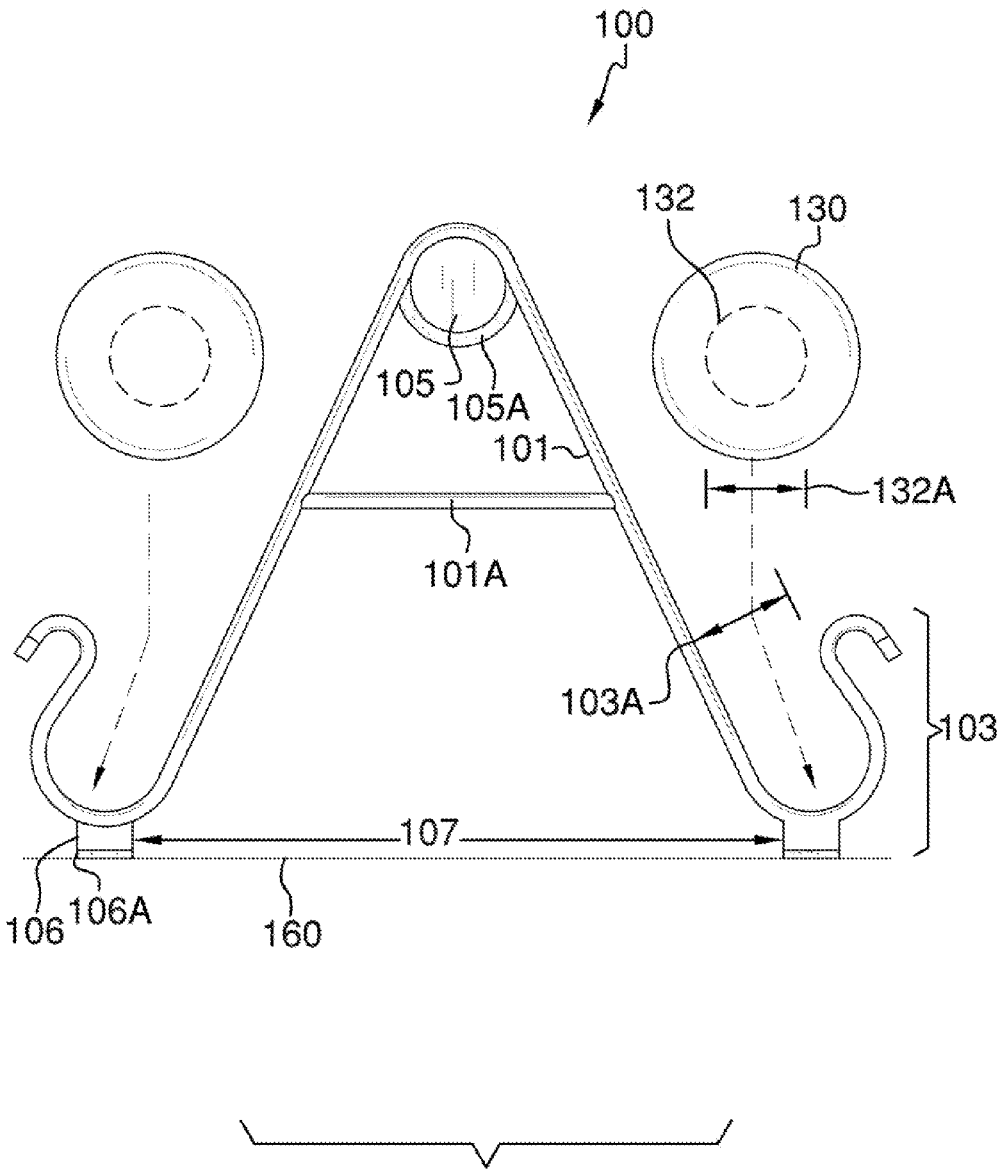
FIG. 2 illustrates a side view of dumbbells aligned above the push-up stand and dumbbell-supporting bracket in which arrows indicate the placement of the dumbbells into the side locations defined by the "U" shaped members.

Referring to FIG. 2, the "U" shaped members 103 shall have an opening defined with a width 103A through which a handle 132 portion of the dumbbell 130 may be inserted, and rest thereon. It shall be noted that the width 103A shall be greater than a width 132A of the handle 132 portion of the dumbbell 130.

The non-skid pads 106 accomplish two tasks: (1) to support the "V"-shaped members 101 at the depth 102 proscribed therein, and (2) to support the invention 100 when in use as a push up stand (see FIG. 4).

The non-skid pads 106 may include a rubber pad 106A along a bottom of the non-skid pad 106, and which creates traction with a ground surface 150.

It shall be noted that the "V"-shaped brackets 101, the cross-braces 101A, the handle 105, and the non-skid pads 106 shall be made of a material comprising a durable plastic, metal, or a carbon fiber composite. Moreover, provided said parts are made of metal, then welding shall be used to secure said parts together in order to form the invention 100.

Figure 3:
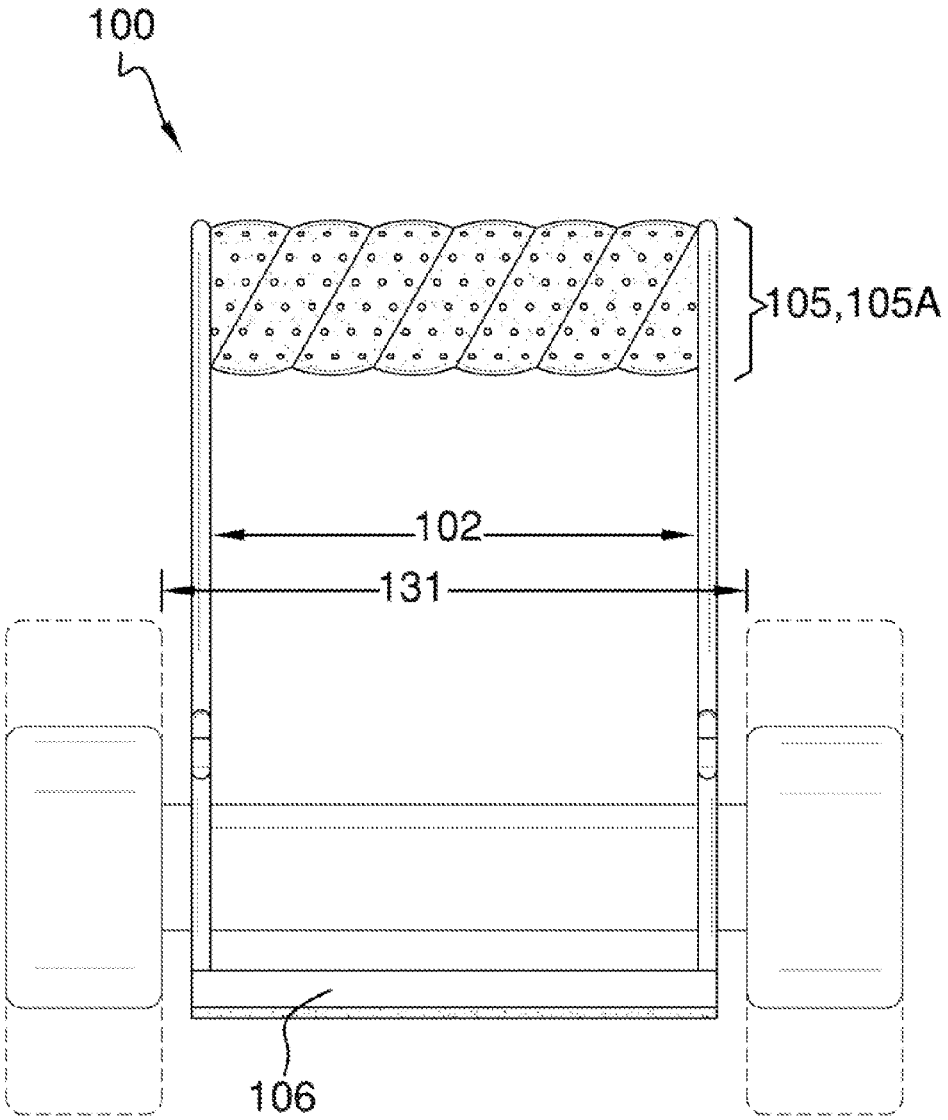
FIG. 3 illustrates a front view of the push-up stand and dumbbell-supporting bracket in which detail is provided as to the handle as well as to a dumbbell situated within the nearest side location as well as a larger dumbbell being depicted in dashed lines.

Referring to FIG. 3, the dumbbells 130 may be of equal or varying weights, and shall be selected at the preference of the end user 141.

Figure 5:
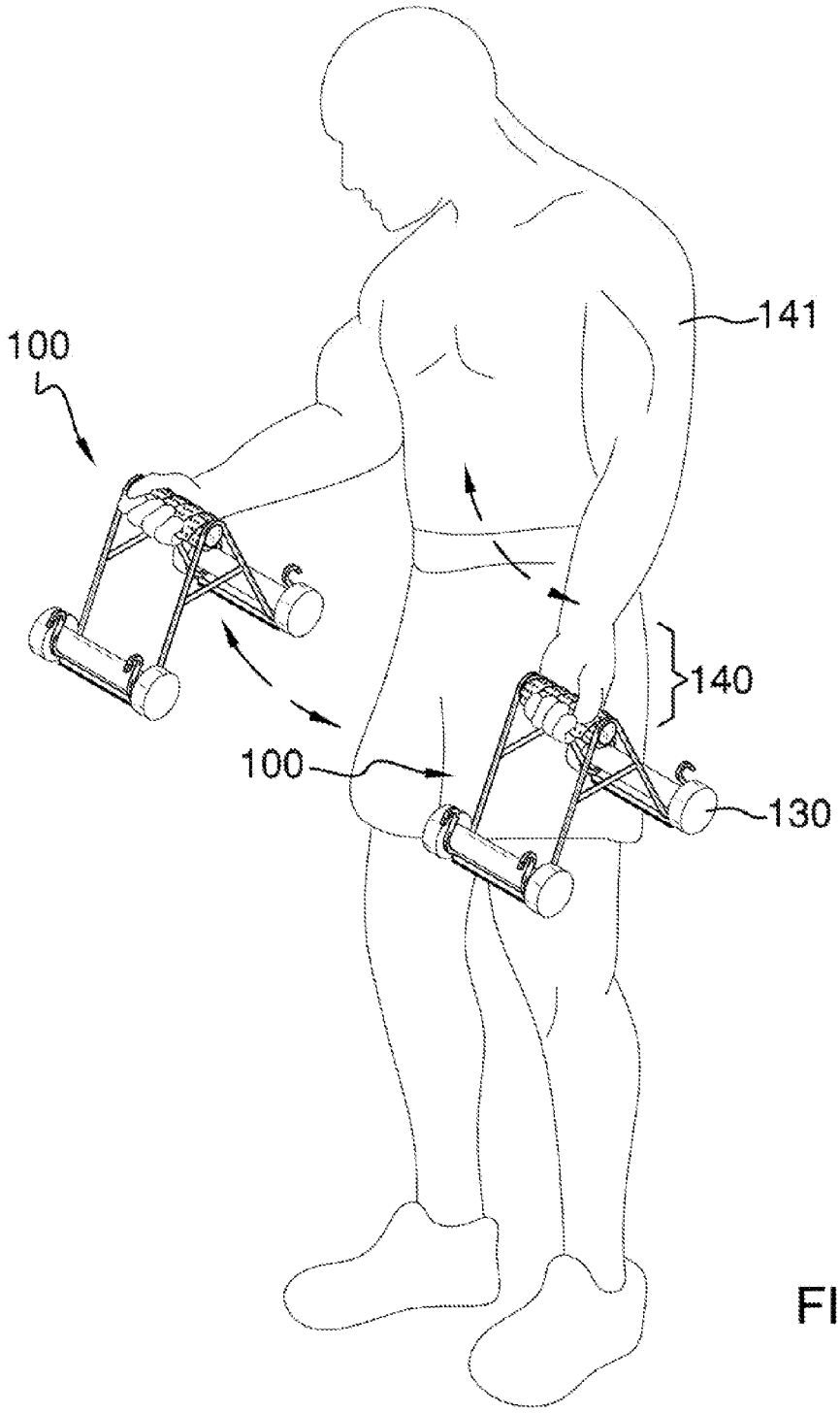
FIG. 5 illustrates a perspective view of two dumbbell-supporting brackets each loaded with dumbbells thereon and held by the handles, and detailing an arm-strengthening exercise (dumbbell circle) being performed therein.

Referring to FIG. 5, the end user 140 appears to be conducting a dumbbell curl exercise with the invention 100 supporting dumbbells 130 thereon. It shall be noted that the dumbbell exercise is one of many types of arm-strengthening exercises that may be accomplished with the invention 100. It shall be further noted that the term "arm-strengthening exercises" is being used to refer to an exercise that is traditionally accomplished with a dumbbell. It shall be noted that the other types of arm-strengthening exercises are well known in the field of dumbbell exercises.

The end user 140 may be using a single invention 100 loaded with dumbbells 130 or two inventions 100 loaded with dumbbells 130 as needed.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A push-up stand and dumbbell-supporting bracket comprising:

two "V"-shaped brackets separated by a depth and in which dumbbells of equal or varying weights are supported thereon and used in connection therewith as a push-up stand or in connection with arm-strengthening exercises traditionally associated with dumbbells;

wherein a handle and non-skid pads attach in between and support the "V"-shaped brackets;

wherein the "V"-shaped brackets each include "U"-shaped members on opposing ends, wherein the "U"-shaped members of both "V"-shaped brackets align to form side locations in which the dumbbells are supported;

wherein the handle is located at a top-most portion of the "V"-shaped members; whereas the "U"-shaped members are located at a lower elevation when compared with the handle;

wherein the handle is covered in a gripping material; wherein the non-skid pads include a rubber pad along a bottom surface, which creates traction when placed on a ground surface;

wherein the "V"-shaped members include cross-braces that attach in between the "V"-shaped member and preserve a span formed between the two opposing "U"-shaped members of the same "V"-shaped member;

wherein the "U" shaped members shall have an opening defined by a width through which a handle portion of said dumbbell is inserted; wherein the width shall be greater than a width of said handle portion of the dumbbell; wherein the depth is less than a handle length of the dumbbell.

* * * * *